United States Patent [19]

Duncan

[11] 4,043,478

[45] Aug. 23, 1977

[54] BEVERAGE CONTAINER WITH INTEGRAL STRAW

[76] Inventor: Richard D. Duncan, 1347 S. Meridian, Indianapolis, Ind. 46225

[21] Appl. No.: 673,198

[22] Filed: Apr. 2, 1976

Related U.S. Application Data

[63] Continuation-in-part of Ser. No. 596,210, July 16, 1975, abandoned.

[51] Int. Cl.[2] ..... A47G 19/22

[52] U.S. Cl. ..... 220/90.2; 206/217; 229/1.5 B; 229/7 S; 215/1 A

[58] Field of Search ..... 220/90.2; 229/7 S, 1.5 B, 229/1.5 C; 215/1A; 206/216, 217

[56] References Cited

U.S. PATENT DOCUMENTS

| | | | |
|---|---|---|---|
| 2,432,132 | 12/1949 | Allen | 229/7 S |
| 3,406,868 | 10/1968 | Rogers | 220/90.2 |
| 3,486,679 | 12/1969 | Pfahler | 215/1 A |
| 3,558,033 | 1/1971 | Leeds | 229/7 S |
| 3,774,804 | 11/1973 | Henning | 229/7 S |

FOREIGN PATENT DOCUMENTS

| | | | |
|---|---|---|---|
| 14,905 | 5/1913 | United Kingdom | 229/1.5 B |
| 598,612 | 8/1946 | United Kingdom | 229/7 S |

*Primary Examiner*—William Price
*Assistant Examiner*—Joseph Man-Fu Moy
*Attorney, Agent, or Firm*—Woodard, Weikart, Emhardt & Naughton

[57] ABSTRACT

A beverage container having a bottom and a contiguous side wall is provided with an integral lid and straw. The straw includes a passageway formed by the cup side wall and a tubular extension thereof which is maintained against the outside of the cup beneath the lid before use. In use, the lid is removed from the outside of the side wall of the container and positioned within the top of the container, and the straw is positioned away from the side wall for drinking a beverage from the container through the passageway and straw.

11 Claims, 6 Drawing Figures

BEVERAGE CONTAINER WITH INTEGRAL STRAW

CROSS-REFERENCE TO RELATED APPLICATION

This application is a continuation-in-part of application Ser. No. 596,210, filed July 16, 1975 now abandoned

BACKGROUND OF THE INVENTION

1. Field of the Invention

The invention is in the field of drinking dispensers with straw attachment.

2. Description of the Prior Art

It is known in the prior art to provide a beverage container with a straw which is maintained in a sealed condition and/or mounted to the body of the container. Examples of such devices are shown in U.S. Pat. Nos. 3,792,798 and 3,623,632, both to Chang; No. 3,349,987 to Weitzner; No. 3,332,567 to Pugh; and 3,445,033 to Sweet et al.

It has also been proposed in the past to provide an integral straw with a beverage container, whereby the side walls of the container form at least a portion of the straw. Such devices are shown in U.S. Pat. No. 3,558,033 to Leeds; No. 2,957,614 to Krajcovic; No. 3,406,868 to Rogers; No. 2,885,134 to Cohen; No. 3,774,804 to Henning; No. 2,432,132 to Allen; and No. 3,349,987 to Weitzner. Quite often the tip of the straw members in the above mentioned patents are provided with some type of covering to maintain the tip of the straw in sanitary condition.

SUMMARY OF THE INVENTION

One embodiment of the present invention is, in a beverage container having a side wall and a contiguous bottom wherein the side wall defines a passageway opening into the interior of the container near the bottom and extending to the top of the side wall, the improvement which comprises a generally tubular portion extending beyond the top of the side wall defining an extension of the passageway, having a first position in which said portion extends outwardly from the top of the side wall of the container and having a second position in which the end of said portion furthest from the top of the side wall is adjacent to the outside of the side wall, and a lid portion having a first position in which it generally covers the top of the container and having a second position releasably attached to the outside of the side wall covering the end of the tube when the tube is in its second position.

It is an object of the present invention to provide an integral beverage container having a side wall and a contiguous bottom which includes an integral drinking straw with a tubular extending portion, which is maintained before use of the container in a sanitary condition adjacent the outside of the side wall of the container beneath a lid portion attached to the side wall and positioned over the straw member, the lid portion being removable to be positioned on top of the container, freeing the end of the straw member for use.

Further objects and advantages of the present invention shall be apparent from the following detailed description and accompanying figures.

DESCRIPTION OF THE PREFERRED EMBODIMENT

Figure 1:
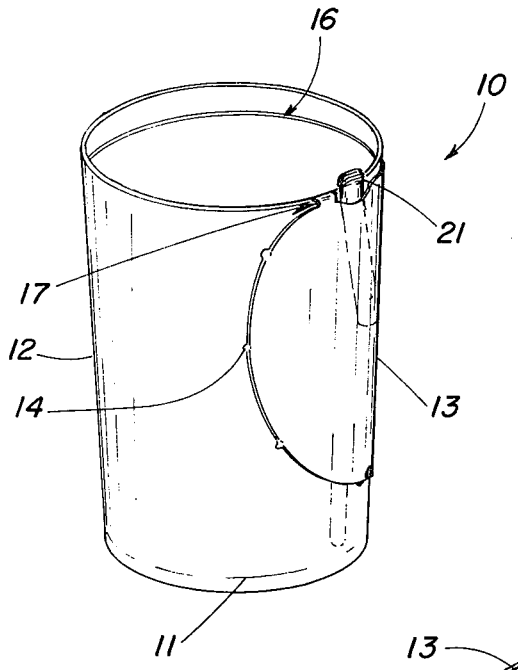
FIG. 1 is a perspective view of an embodiment of the present invention with the lid and straw positioned for shipment or storage before use.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
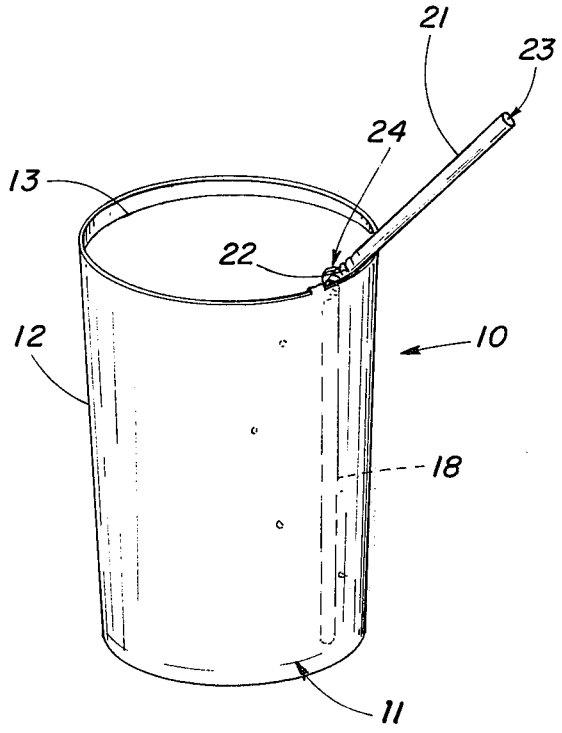
FIG. 2 is a perspective view of the embodiment of FIG. 1 with the lid and straw member positioned for use of the container for drinking a beverage therein.
Figure 3:
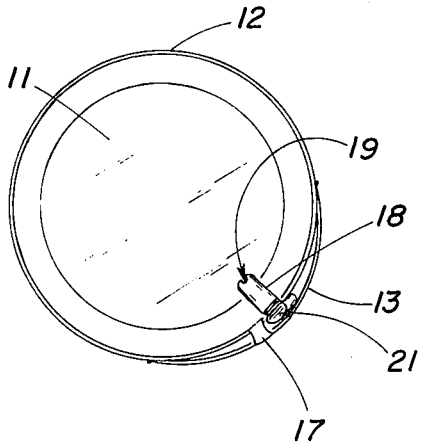
FIG. 3 is a top view of the container as shown in FIG. 1.

Referring in particular to FIG. 1, there is shown a beverage container 10 according to the present invention. Container 10 has an upwardly extending side wall 12 and a contiguous bottom portion 11. As shown in FIGS. 1 and 3, a lid portion 13 is releasably attached to the outside of generally frusto-conical side wall 12 of container 10. Lid 13 is sized to enclose most of the top of container 10 and in the storage and shipment configuration of FIGS. 1 and 3 is attached to the outside of side wall 12 by a series of heat-seal spots such as 14. A small groove 16 is provided about the interior of the top of side wall 12, whose width is approximately equal to the thickness of lid 13. When lid 13 is positioned on top of container 10 as shown in FIG. 2, the lid is received and held within groove 16. A tab 17 is provided to maintain attachment between lid 13 and side wall 12, after lid 13 is removed from the side wall by breaking heat-seal spots 14, for positioning within the top of container 10.

Side wall 12 also defines a passageway portion 18 which provides a passage from the bottom of container 10 to the vicinity of the top of side wall 12. An opening 19 at the bottom of passageway member 18 enables liquids in container 10 to be drawn into the passageway member 18 and to the top of side wall 12.

A tubular straw extension 21 is provided in sealed communication with the passageway in member 18. As shown in FIG. 2, when lid 13 is removed from side wall 12, straw portion 21 is free to be positioned for drinking a liquid beverage in container 10. During shipment or storage of stacks of containers such as 10, straw portion 21 is maintained in a semi-flattened position beneath lid 13 when the lid is heat sealed at points 14 to the outside of side wall 12. The maintenance of lid 13 over the end of straw 21 keeps the straw in sanitary condition and yet eliminates the requirement for a separate sealing member to maintain this condition. Straw portion 21 at its junction point with passageway member 18, includes a pleated or folded portion 22 for added flexibility.

Side wall 12 extends slightly below the bottom 11 of container 10, as is standard with beverage containers which are provided in a stacked condition in shipment. The container 10 may be molded from a plastic material with the thickness of straw portion 21, the part of side wall 12 defining passageway member 18, and lid 13 including tab 17 being of a thickness to permit a certain degree of flexibility. In this manner, stacking of the cups may be accomplished with straw portion 21 and passage member 18 being flattened somewhat in shipment and storage, yet being resilient enough to return to their original expanded form when container 10 is used for a beverage. It would be alternatively possible to provide a portion of side wall 12, perhaps opposite the location of passage member 18, in an indented configuration, to accommodate the passage member on a cup beneath it in a stack.

Container 10 may also be provided in other materials such as waxed cardboard with the attachment points 14 between lid 13 and the outside of side wall 12 being paper connections. Straw member 21 is provided at an angle as shown in dotted lines in FIG. 1 in the storage and shipment configuration so as not to compound the thickness at the location where passage member 18 runs within side wall 12 of container 10. This facilitates the stacking of the cups without special provision of indentations in side wall 12 or other means. In use, beverage container 10 may be filled with a beverage when in its position indicated in FIGS. 1 and 3, and then lid 13 is broken away from the outside of side wall 12 by breaking the small heat-seals 14 and inserted within groove 16 to cover the top of container 10. Opening 24 is provided in lid 13 for the passage of straw portion 21.

Straw member 21 is then removed from alongside side wall 12 and placed in a position as indicated in FIG. 2. The beverage within container 10 is removed by applying suction to the straw member 21, drawing the beverage from the bottom of the container 10 through opening 19 and the interior of passageway member 18, through straw member 21 and out opening 23 in the end of straw member 21.

Figure 4:
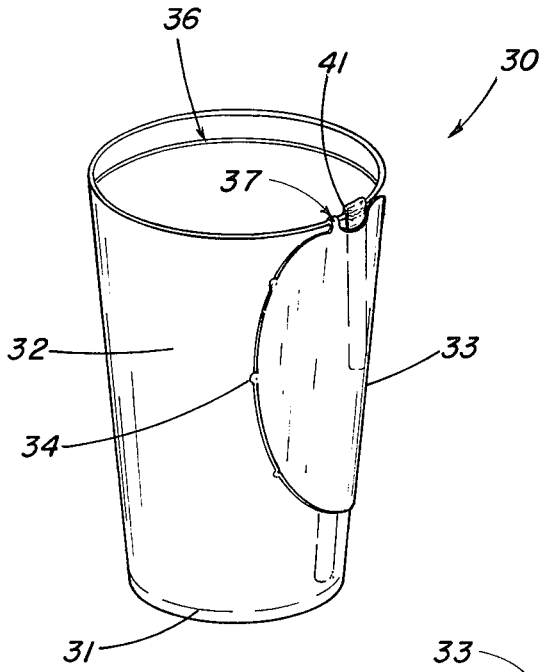
FIG. 4 is a perspective view of a further embodiment of the present invention with the lid and straw positioned for shipment or storage before use.
Figure 6:
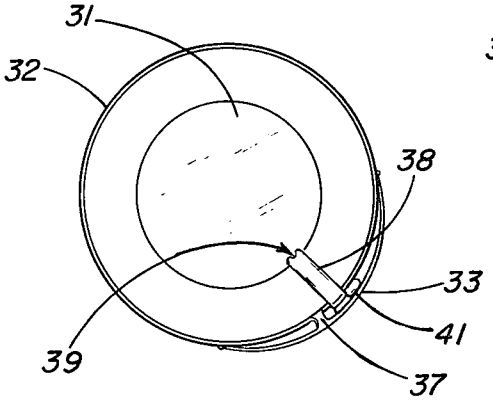
FIG. 6 is a top view of the container as shown in FIG. 4.
Figure 5:
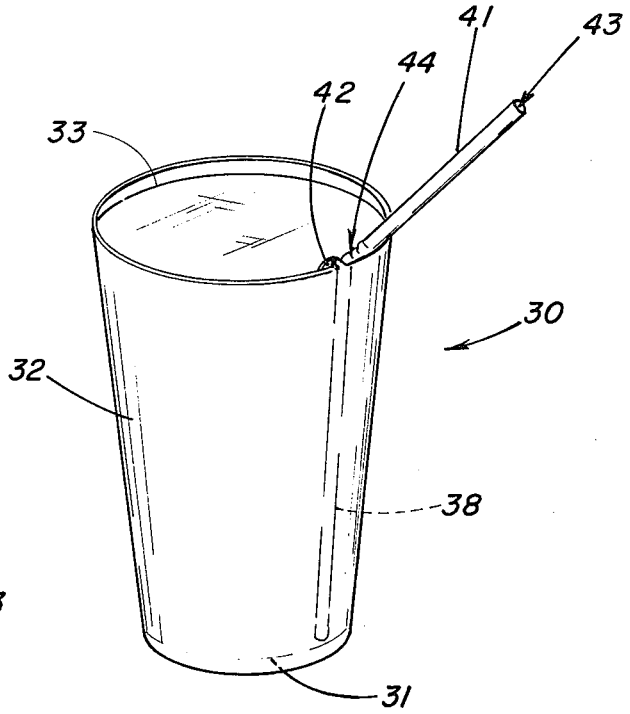
FIG. 5 is a perspective view of the embodiment of FIG. 4 with the lid and straw member positioned for use in the container for drinking a beverage therein.

Referring now to FIGS. 4–6, there is shown a further embodiment of the present invention. In FIG. 4, a beverage container 30 has an upwardly extending side wall 32 and a contiguous bottom portion 31. As shown in FIGS. 4 and 6, a lid portion 33 is releasably attached to the outside of side wall 32 of container 30. Lid 33 is sized to enclose most of the top of container 30 and in the storage and shipment configuration of FIGS. 4 and 6 is attached to the outside of side wall 32 by a series of heat seal spots such as 34. A small groove 36 is provided about the interior of the top of side wall 32 whose width is approximately equal to the thickness of lid 33. When lid 33 is positioned on top of container 30 as shown in FIG. 5, the lid is received and held within groove 36. A tab 37 is provided to maintain attachment between lid 33 and side wall 32, after lid 33 is removed from the side wall by breaking heat seal spots 34 for positioning within the top of container 30.

The tab 37 is shown in FIGS. 4 and 6 in a continuous, untwisted configuration and is preferably a thin flexible plastic tab. As shown in FIG. 5, the tab 37 is twisted when lid 33 is positioned within the top of the cup for closing the cup. In this manner, the unexposed surface of lid 33, which has been maintained in sterile condition against the outside of the cup's side wall 32 as shown in FIGS. 4 and 6, is now the side of lid 33 which faces the beverage within container 30. In order for the desired surface of lid 33 to be facing the beverage in container 30, the lid must be brought around, twisting tab 37, rather than swung up and over the opening of the cup.

Side wall 32 also defines a passageway portion 38 which provides a passage from the bottom of container 30 to the vicinity of the top of side wall 32. Opening 39 at the bottom of passageway member 38 enables liquids in container 30 to be drawn into the passageway member 38 and to the top of side wall 32.

A tubular straw extension 41 is provided in sealed communication with the passageway in member 38. As shown in FIG. 5, when lid 33 is removed from side wall 32, straw portion 41 is free to be positioned for drinking a liquid beverage from container 30. During shipment or storage of stacks of containers such as 30, straw portion 41 is maintained in a semi-flattened position beneath lid 33 when the lid is heat sealed at points 34 to the outside of side wall 32. The maintenance of lid 33 over the end of straw extension 41 keeps the straw in sanitary condition and yet eliminates the requirement for a separate sealing member to maintain this condition. Straw portion 41 at its junction point with passageway member 38, includes a pleated or folded portion 42 for added flexibility.

Side wall 32 extends slightly below the bottom 31 of container 30, as is standard with beverage containers which are provided in a stacked condition in shipment. The container 30 may be molded from a plastic material with the thickness of straw portion 41, the part of side wall 32 defining passageway member 38, and lid 33 including tabs 37, being of a thickness to permit a certain degree of flexibility. In this manner, stacking of the cups may be accomplished with straw portion 42 and passage member 38 being flattened somewhat in shipment and storage, yet being resilient enough to return to their original expanded form when container 30 is used for a beverage. It would be alternatively possible to provide a portion of side wall 32, perhaps opposite the location of passage member 38, in an indented configuration, to accommodate the passage member on a cup beneath it in a stack.

Container 30 may also be provided in other materials such as waxed cardboard with the attachment points 34 between lid 33 and the outside of side wall 32 being paper connections. Straw member 41 is provided at an angle as shown in dotted lines in FIG. 4 in the storage and shipment configuration so as not to compound the thickness at the location where passage member 38 runs within side wall 32 of container 30. This facilitates the stacking of the cups without special provision of indentations of side wall 32 or other means. In use, beverage container 30 is filled with a beverage while in its configuration indicated in FIGS. 4 and 6, and then lid 33 is broken away from the outside of side wall 32 by breaking the small heat seals 34, and the lid 33 is inserted within groove 36 to cover the top of container 10. In this operation, the lid 33 is inverted, as indicated earlier, placing the sanitary side of lid 33 adjacent the beverage in the container and placing a twist in tab 37 which connects the lid 33 to the side wall 32 of the container. Opening 44 is provided in lid 33 for the passage of straw portion 41 when the lid is in the position shown in FIG. 5.

Straw member 41, after the placement of lid 33 as shown in FIG. 5, is then removed from side wall 32 and placed in the position indicated in FIG. 5. The beverage witin container 10 is then removed by applying suction to the straw member 41, drawing the beverage from the bottom of container 30 through opening 39 and the interior of passageway member 38, through straw member 41 and out opening 43 in the end of straw member 41.

The embodiment of FIGS. 4–6 is somewhat more tapered in configuration that the embodiment of FIGS. 1–3 in order to more clearly resemble traditional beverage cups and in order to provide an embodiment more appropriate for stacking of the containers for shipment. It can be seen that a beverage container has been provided which contains an integral straw and lid and maintains these elements in a sterilized condition without the use of excess materials for covering or protection. The underside of lid 33, adjacent the outside of side wall 32 and straw end 41 during shipment and storage, may be appropriately sealed about its edge as necessary to maintain the sterile condition of the underside of the lid and the straw end 41. With the inversion of lid 33 and twisting of tab 37, when the lid is placed on the container 30 in the configuration of FIG. 5, and straw end 41 is released for use, the straw and lid are provided for use in sterile condition.

While there have been described above the principles of this invention in connection with specific apparatus, it is to be clearly understood that this description is made only by way of example and not as a limitation in the scope of the invention.

What is claimed is:

1. In a beverage container having a side wall and a contiguous bottom wherein the side wall defines a passageway opening into the interior of the container near the bottom and extending to the top of the side wall, the improvement which comprises:

a generally tubular portion extending beyond the top of the side wall defining an extension of the passageway, having a first position in which said portion extends outwardly from the top of the side wall of the container and having a second position in which the end of said portion furthest from the top of the side wall is adjacent the outside of the side wall; and a lid portion having a first position in which it generally covers the top of the container when the tubular portion is in its first position and having a second position releasably attached to the outside of the side wall covering the end of the tubular portion when the tubular portion is in its second position.

2. The improvement of claim 1 which further comprises a tab portion connecting the lid portion to the top portion of the side wall of the container.

3. The improvement of claim 2 in which the generally tubular portion and the portion of the side wall defining the passageway are flexible.

4. The improvement of claim 3 which further comprises first means for releasably attaching the lid portion to the outside of the side wall when the lid portion is in its second position.

5. The improvement of claim 4 in which the container is a plastic material and the first means is a plurality of heat-seal spots.

6. The improvement of claim 5 in which the generally tubular portion is a tube having a circular cross-section when in an unflattened condition and includes a pleated portion adjacent the top of the side wall.

7. The improvement of claim 2 in which the interior of the top portion of the side wall includes a groove receiving the lid portion when it is in its first position, the lid portion being sized to be received within the top portion of the side wall of the container.

8. In a beverage container having a side wall and a contiguous bottom wherein the side wall defines a passageway opening into the interior of the container near the bottom and extending to the top of the side wall, the improvement which comprises:

a generally tubular portion extending beyond the top of the side wall defining an extension of the passageway, having a first position in which said portion extends outwardly from the top of the side wall of the container and having a second position in which the end of said portion furthest from the top of the side wall is adjacent the outside of the side wall; and a lid portion having a first position in which it generally covers the top of the container when the tubular portion is in its first position and having a second position in which it is releasably attached to the outside of the side wall covering the end of the tubular portion when said portion is in its second position, the side of the lid facing the inside of the container when the lid portion is in its first position being the side of the lid adjacent the side wall and the end of said tubular portion when the lid is in its second position.

9. The improvement of claim 8 and which further comprises a tab portion connecting the lid portion to the top portion of the side wall of the container.

10. The improvement of claim 9 in which the interior of the top portion of the side wall includes a groove receiving the lid portion when it is in its first position, the lid portion being sized to be received within the top portion of the side wall of the container.

11. The improvement of claim 10 and which further comprises first means for releasably attaching the lid portion to the outside of the side wall when the lid portion is in its second position.

* * * * *